United States Patent [19]

Sandberg

[11] 4,037,335

[45] July 26, 1977

[54] METHOD OF CONTROLLING A MOBILE SUCTION DEVICE FOR SUCKING SUSPENDIBLE MATERIAL FROM THE BOTTOM OF A LIQUID BODY, AND AN APPARATUS FOR CARRYING OUT THE METHOD

[75] Inventor: Nils Arne Sandberg, Hassleholm, Sweden

[73] Assignee: Ingenjörsfirman N.A. Sandbergs Industrikonstruktioner AB, Hassleholm, Sweden

[21] Appl. No.: 574,280

[22] Filed: May 5, 1975

[30] Foreign Application Priority Data

Aug. 29, 1974 Sweden ..... 7410937

[51] Int. Cl.[2] ..... E02F 3/88

[52] U.S. Cl. ..... 37/58; 137/4; 137/8; 318/644; 318/567; 318/570; 37/195

[58] Field of Search ..... 37/58, 59, DIG. 1, 68, 37/64, 67, 195; 137/2, 4, 8, 9, 92; 417/18, 20, 22–24; 251/30; 318/644, 567, 570, 568

[56] References Cited

U.S. PATENT DOCUMENTS

| | | | |
|---|---|---|---|
| 1,062,926 | 5/1913 | Reid et al. | 37/58 X |
| 1,231,613 | 7/1917 | James | 37/58 X |
| 2,250,021 | 7/1941 | Hofer | 37/58 |
| 2,661,550 | 12/1953 | Graham | 37/58 |
| 2,938,536 | 5/1960 | Ehrenberg | 37/58 X |
| 3,224,121 | 12/1965 | Denning | 37/58 |
| 3,493,345 | 2/1970 | Windley | 137/92 X |
| 3,628,263 | 12/1971 | Van der Veen | 37/58 |
| 3,633,597 | 1/1972 | Jobe | 137/8 |
| 3,707,978 | 1/1973 | Volk, Jr. | 137/2 |
| 3,772,805 | 11/1973 | Koning | 37/58 |

*Primary Examiner*—E. H. Eickholt
*Attorney, Agent, or Firm*—Blair & Brown

[57] ABSTRACT

This invention is directed to an apparatus comprising a suction device having at least one nozzle for sucking suspendible material as a suspension from a bed of said material, means for producing suction in the nozzle and means for moving the nozzle horizontally and vertically in relation to said bed, and the invention relates more particularly to a method of controlling the horizontal and vertical movements of the suction device by utilizing as control signals the variations of the solids concentration and volume of suspension sucked through the nozzle per unit of time, and the invention also comprises an apparatus having means for carrying the method into effect.

9 Claims, 6 Drawing Figures

M1
M2
M3
R1
R2
R3
R4
S
L1
L2
F1
F2
P
P2
Pb
P1
H
Δq
q

METHOD OF CONTROLLING A MOBILE SUCTION DEVICE FOR SUCKING SUSPENDIBLE MATERIAL FROM THE BOTTOM OF A LIQUID BODY, AND AN APPARATUS FOR CARRYING OUT THE METHOD

The present invention relates to a method of controlling a mobile suction device used for sucking material which is suspendible in fluid, especially sedimented material, such as sludge, sand or other material in the form of solid particles, from the bottom of a liquid body, said device including at least one suction nozzle, a pump connected to the nozzle and means for moving at least said nozzle in the liquid body. The invention also comprises an apparatus including means for carrying the method into effect.

It is previously known in sucking sediments from the bottom of ponds, basins, etc. to move a suction nozzle to and fro in predetermined paths along the bottom by a supporting means travelling on or above the water surface.

However, the level of sediment may vary and so may the density and concentration of the sediment, and, if the sedimentation has taken place under fractionation, then also the average size or weight of the particles may vary, and if under such conditions the suction nozzle travels at a constant speed and at a constant depth, then the suction flow rate, i.e. the volume per unit of time, and/or the solids concentration of the inflow may vary largely during the movement of the suction nozzle with the result that the plane operates at an unsatisfactory average capacity. An obvious example of this is a plant for sucking slurry in a sedimentation basin where solids have sedimented from a slurry in fractions and form on the basin bottom a sludge bed having a profile which is characteristic of the slurry composition and comprises one or more peaks which are represented in the basin by transverse banks which may be formed of material in different fractions. When the suction nozzle is moved at a constant speed and at a constant depth from one end to the other of the basin, then the solids concentration in the inflow into the nozzle will vary in dependence on the sediment level and the type of fraction due to the fact that the density of the material in the bed varies with the depth of the bed, the time of sedimentation and the average particle weight in the various fractions therof. Where the nozzle moves through a shallow portion of the bed, the density is relatively low and the inflow will have a low solids concentration, which means that it is substantially water that is pumped and that the flow rate is relatively high, and where the nozzle moves through a bank and thus is deeper down in the sludge, the density is higher and, consequently, the inflow will have a higher solids concentration and the flow rate decreases.

To overcome this problem it has been proposed to regulate the travelling velocity of the nozzle so as to maintain the solids concentration and the volume per unit of time of the inflow approximately constant during the travel of the nozzle along the basin but this regulation technique has not come up to expectations. When regulating the travelling velocity of the suction device, the velocity control is for natural reasons limited to a range between zero and the maximum travelling velocity admitted by the suction nozzle conveying means, and when the device operates at these limit values, there is no longer any control of the travelling velocity and consequently no guarantee for the flow and concentration being constant. When using conventional slurry suction plants, the solids concentration will increase and the flow rate will decrease, in spite of the speed regulation, when the nozzle is carried through a sedimentation bank, and the case is just the opposite when the nozzle has passed through the bank.

The term "slurry" as used herein designates a suspendible material in sedimentation beds or banks, which is sucked suspended in a fluid, which generally is a liquid such as water, but the invention is also theoretically applicable to suspensions of material suspended in other fluids, such as air, which means that slurry also, inadequately, is used to designate such suspensions. It is also understood that this suspendible material may be in a more or less suspended condition in said bed, as is generally the case with such material as sludge.

The present invention is based on the idea of allowing the solids concentration and the volume per unit of time of the inflow to vary within relatively narrow limits and utilizing as resetting signals the variations around a desired value, and this idea has been realized by the method of this invention, wherein at least one magnitude, which is characteristic of the operation of the suction device and which varies in response to the rate of flow into the nozzle, is sensed, and variations of said magnitude passing predetermined limits are used as signals for controlling certain movements of the device.

Preferred embodiments of the invention are characterized by the following features:

Said variations of the sensed magnitude are used for controlling the operating level of the nozzle;

Said variations of the sensed magnitude are used for controlling a movement of the nozzle in horizontal direction;

Said variations of the sensed magnitude are used for controlling a movement of the nozzle in horizontal direction and for controlling the operating level of the nozzle;

Said variations of the sensed magnitude are used for changing program in a programmed movement and depth level adjustment of the nozzle;

The power fed to an electric pump motor or, as a measure of the power, the current consumption thereof is sensed as a magnitude;

Said variations of the sensed magnitude are utilized as electric control demand signals which are transmitted to an electric circuit for transforming said signals into control signals and transmitting the control signals to an electric depth adjustment motor for controlling the operating level of the nozzle;

At least one controlled movement of the suction device is carried out in controlled steps;

Said controlled steps of movement are carried out with an amplitude and a frequency which are proportional to said variations of the sensed magnitude;

The movements of the suction device are controlled along three perpendicular axes;

The time is introduced, via a timer, as a fourth dimension into the control operation;

Said variations of the sensed magnitude are also used for controlling a valve means in the pump conduit.

Thus, the method of the invention is based on controlling around desired values the flow rate, i.e. the volume of flow per unit of time through the nozzle, and the solids concentration in the flow. However, to dispense with flow meters and concentration meters or transmitters, which are sensitive to disturbances and relatively expensive, instead the variations of power fed to the pump motor or its consumption of current are utilized as signals for resetting towards a desired value. To this end there is used a pump with a pump motor whose power curve, within at least an appropriate working area, increases at least approximately proportionally to the increase of the pump flow. Pumping equipments of this kind are available on the market, and the control method of the invention therefore involves no additional cost as far as the pumping equipment is concerned. Thus, when using a pumping equipment of this kind, the pump motor power consumption will increase with increased inflow into the nozzle, and vice versa, and as the flow rate, i.e. the volume per unit of time, decreases with increasing solids concentration, and vice versa, there is every reason to contend that sensing of the variation of the pump motor power input is equivalent to the sensing of the flow rate and the solids concentration. Therefore, the pumping equipment may be utilized as a flow rate and concentration meter.

Thus, the method of this invention makes use of a per se known technique in a new manner for utilizing variations of a magnitude around a desired value as a demand signal for resetting the magnitude proper towards the desired value and, according to the invention, this resetting demand signal is transmitted to that device by means of which the suction nozzle is moved, in order to control the movement or to actuate a movement program or effect changes of movement programs such that the inflow into the nozzle and the solids concentration are kept within predetermined and relatively narrow limits on either side of a predetermined or preset desired value. It appears from the foregoing that this invention provides for the fact that the device for moving the nozzle in certain cases, or generally, also is capable of raising and lowering the nozzle, in addition to moving the nozzle horizontally, and in order to simplify and make as efficient as possible the control operation it is proposed that at least certain phases of the nozzle movement be carried out in response to time. This means, for example, that suction of slurry can be carried out by means of a nozzle which, in dependence on varying levels of banks in the sludge and solids concentration thereof, is three-dimensionally controlled i.e. along three perpendicular axes, and by impressing a time factor which, as the fourth dimension, completes the three-dimensional control.

The method of the invention eliminates "blind" control of the movement of the suction device, such as by speed changes according to programs previously established on the basis of a guessed or expected sludge bed profile, and the invention dispenses with the use of specific bed or bank depth sensing means. The invention also eliminates that necessity of sucking slurry from a determined depth, which generally is associated with conventional methods for drawing up sediments from the bottom in sedimentation plants or from sediment beds and which results in that the suction nozzles during their movements will whirl up some matter which thus will be suspended in the water and, also, in that the nozzles during their travel for example along the bottom of a sedimentation basin will meet a resistance varying with the depth and composition of the solid matter so that the sedimented matter, where it is tenacious, will form a heavy impediment to the nozzle movement and also may be harmful to the nozzles or associated suction pipes and connections.

The invention also comprises an apparatus for carrying out the method of this invention, for controlling the movement of a suction device used for sucking material which is suspendible in fluid, from the bottom of the liquid body, including at least one suction nozzle, means for producing suction in the nozzle, and means supporting the nozzle for moving the nozzle in the liquid body, said device comprising sensing means for sensing variations of a magnitude related to the rate of flow through the nozzle and a signal producing means connected to said sensing means to be actuated thereby for transmitting signals proportional to said variations, and an electric control circuit connected to said signal producing means and to said means supporting said nozzle, said circuit being adapted, on receiving signals from said signal producing means representing variations of said magnitude above certain limit values or around a set value, to transmit such signals to the nozzle moving device to be guided by the nozzle.

Preferred embodiments of the apparatus of this invention are characterized by the following features:

The sensing means are adapted to sense the consumption of electric energy of the pump motor, and said means for supporting and moving said nozzle comprise a depth level control means including an electric motor connected to said electric control circuit to be automatically controlled thereby in response to said control signals from said signal producing means;

Said sensing means are connected to sense the consumption of electric energy of the pump motor, and said means for supporting and moving said nozzle comprise a drive means for moving said nozzle in the horizontal direction, said drive means being connected to said control circuit to be automatically controlled thereby for moving said nozzle in at least one horizontal direction.

The invention will be described more fully below with reference to the accompanying drawings, in which.

Figure 1:
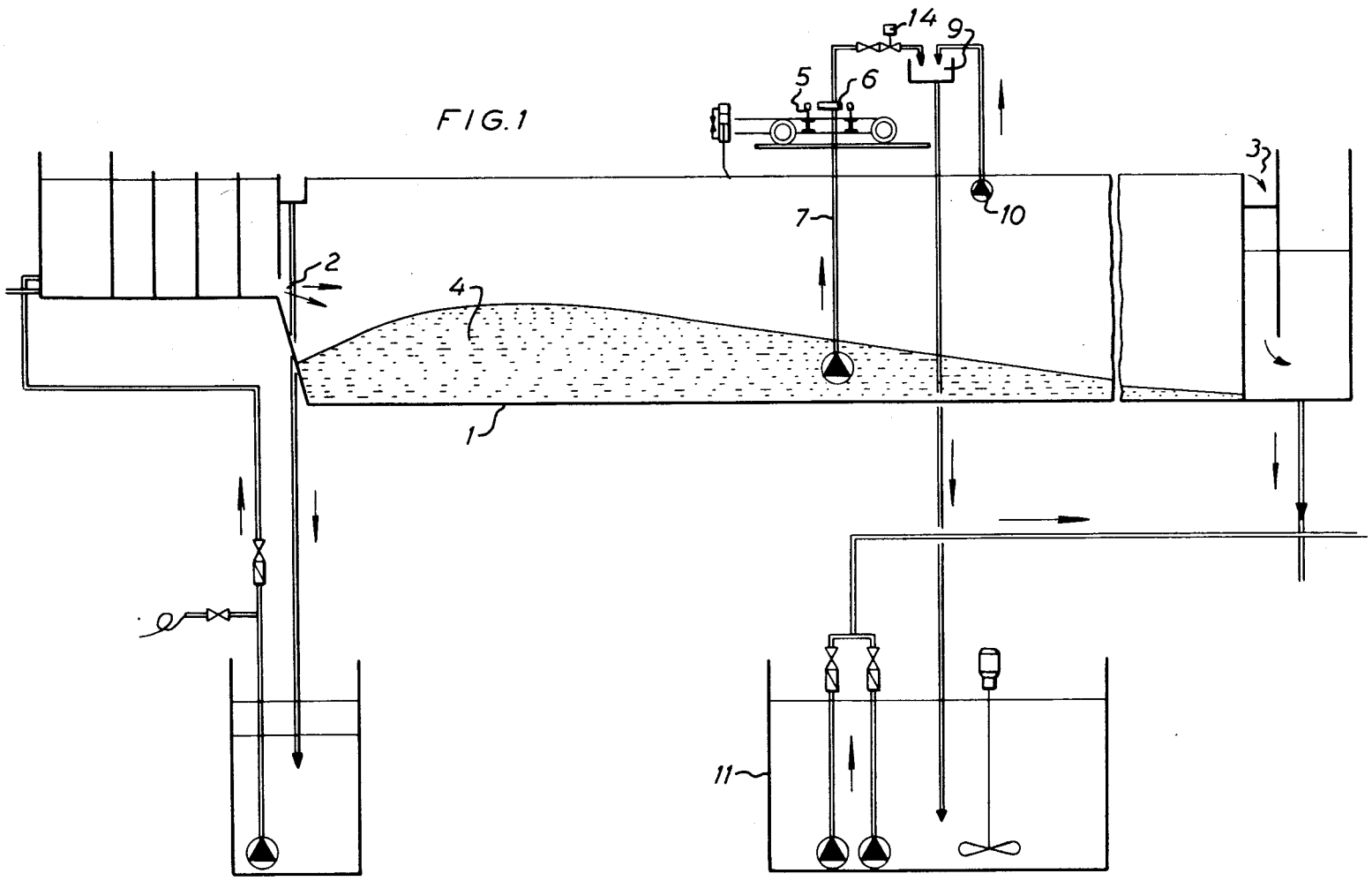
FIG. 1 is a schematic view of a sedimentation plant including an equipment according to the invention for sucking suspendible material, such as sludge, from the bottom thereof and delivering said material as a slurry or suspension in water to a chute for transporting said material to a station for further treatment.

In the drawings the invention is illustrated as applied to a device for the evacuation of slurry from the bottom of a parallelepipedic sedimentation basin 1 into which, at one end of the basin, contaminated water from a pump mill is introduced through an inlet 2 for purification or so-called clarification, and from which basin clear water is discharged at the other end of the basin over an overflow outlet at 3. The contaminating solid particles in the water deposit on the bottom of the basin and form there a bed 4 of sludge having a certain profile depending on the type of contaminations, the size and the length/width relation of the basin, the reaction rate of the water and the time of sedimentation. The sludge bed profile shown in FIG. 1 is assumed to have formed after a certain time during which no slurry has been sucked away.

The basin 1 is provided with a slurry suction equipment including a travelling crane 5 which is movable over the basin in the longitudinal direction thereof and carries a travelling crane carriage 6 which is movable on the travelling crane in the transverse direction of the basin. The carriage 6 carries a flexible conduit 7 which, at its lower end, carries a submersible suction and force pump 8 including an electric motor for sucking a suspension of sludge and water and drawing the suspension up through the conduit 7. Instead of a submersible pump it is possible to use a pump supported on the travelling crane, e.g. a pump for pumping a fluid (water, air) to the conduit 7 above a nozzle at the lower end of the conduit for producing suction in the nozzle and for drawing up suspension through the conduit. Means of this type are previously known and are therefore not specifically described herein.

The suspension transported through the conduit 7 is poured into a chute 9 or like means into which rinse water may be pumped by means of a pump 10 from the water surface layer in the basin. From the chute the suspension is passed on, by means of a conduit for further treatment, e.g. to a homogenizing tank 11 or a filtering apparatus. The other details shown in FIG. 1 are of no interest to the invention and are therefore not described herein.

Figures 2, 3:
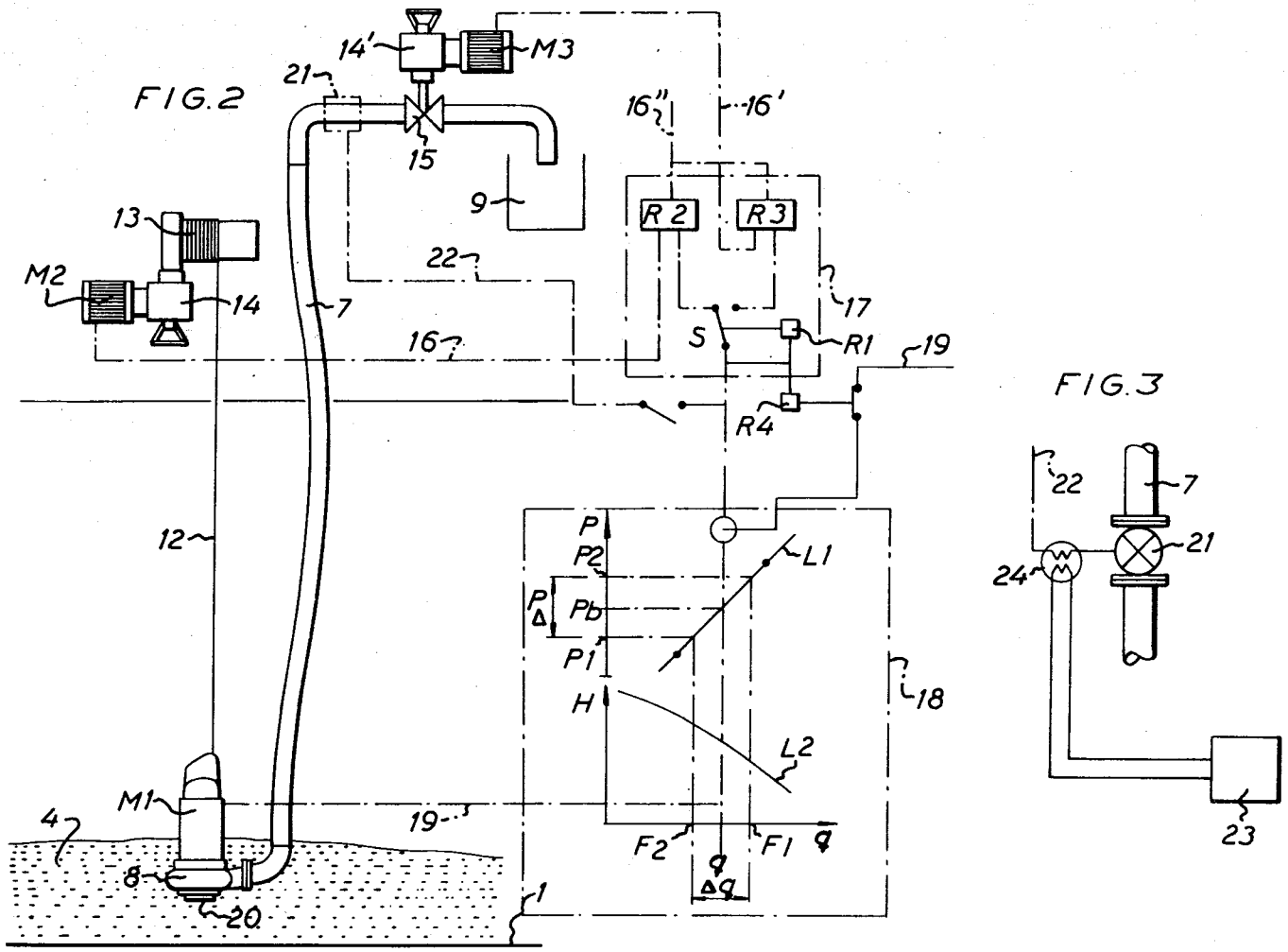
FIG. 2 is a schematic view showing a part of the slurry sucking equipment of FIG. 1 and a device including a pump motor power sensing means for controlling said part.
FIG. 3 shows a flow meter as an example of a sensing means possibly replacing or supplementing the power sensing means.

FIG. 2 shows the conduit 7, the pump 8 with its electric motor, which is designated M1, and the chute 9. The pump 8 is carried so that it can be raised and lowered by means of a rope 12 extending upwardly to a winch drum 13 which is driven by means of an electric motor M2 via a gear 14. The gear 14 is equipped with a built-in control means of per se known type comprising power and distance circuit breakers of which the distance circuit breaker at the same time functions as a signal means for the respective end position. Units comprising an electric motor M2 and a gear 14 with control means of this type are known and for this purpose there may be used, for example, such units as are sold by Erichs Armatur AB in Malmo under the designation Auma Typ SA. However, instead of the winch 13 and the motor M2 with the gear and control means 14, it would be possible to use a telpher with conventional control equipment, which can be connected for automatic control in a manner equivalent to the following description.

Arranged in the conduit 7 is a valve 15 adapted to be operated by means of a unit M3, 14' similar to the unit M2, 14 described above. The electric regulating circuits 16, 16' of the electric motors M2, M3 are connected to a regulating circuit, generally designated by 17, which is connected to a power sensing means 18 which is adapted to sense the power in the feed circuit 19 of the pump motor M1. How this sensing operation is arranged more exactly is not shown since there are several different possibilities available in this respect. As a power sensing means there may be used e.g. an ammeter connected to an electric signal producing means depending on the current intensity. The electric regulating circuit 17 includes a switch S operated by a relay R1 connected to the signal circuit, and two regulators R2, R3 of which R2 is connected to M2 and R3 to M3. As will be described below, R1 is a relay with time delay for switching from R2 to R3.

As pump 8 and pump motor M1 there is used a unit operating with the power and pump characteristic shown at 18 in FIG. 2, where P indicates the power, 2 the pump flow and H the height of delivery. The power of the pump motor M1 and the flow of the pump 8 rise substantially proportionally to each other according to the lines L1 and L2, respectively. Pumping units having practically straight power and flow characteristics within the entire normal working area are since long available in the market and operate in such a way that a flow change $\Delta q$ corresponds to a power change $\Delta P$ and vice versa.

This property is utilized in the sensing means 18 for transmitting reliable control demand signals to the regulating circuit 17.

It is assumed that the pump 8 by means of the travelling crane 5 in FIG. 1 is run into a sludge bank where the height of sludge on the basin bottom increases. Due to the fact that the sludge density increases with the height of sludge, the inflow of suspension (sludge and water) into the pump nozzle 20 decreases and, as a consequence thereof, also the pump motor power decreases. The decrease of the power is sensed by means of the power sensing means 18 which, via the relay switch S, transmits a signal to the regulator R2. If the flow from the desired value fb towards a threshold F2 and the power consequently decrease from a corresponding desired value Pb towards a threshold P2, a corresponding demand signal is transmitted to R2 which starts the winch motor M2 for raising the pump 8 proportionally to the demand signal. The elevation may take place by steps determined by means of a time relay and if the power value, after one step, still is too low and R2 still transmits a control signal in this respect to M2, then M2 starts again and raises the pump 8 another step, etc. In the meantime the pump may be moved forwards by means of the travelling crane 5. When the pump 20 with its suction nozzle 20 reaches a point where the thickness of the sludge bed and the inflow into the nozzle increase because the sludge consistency decreases and a proportionately larger amount of water is sucked in, the power sensing means 12 transmits a demand signal via the switch S to the regulator R2 to lower the pump, while R2 starts the motor M2 in the opposite direction (ore relieves a brake for the winch 13) for lowering the pump 8 one step, which may be repeated. The pump motor M1 should operate within the power limits P1–P2 in FIG. 2, and if any of these power limits are exceeded, e.g. to some of the points P1, P2, then e.g. an indicator may be brought into contact with a limit position contact K1 or K2 to stop further raising or lowering. Within the working area the adjustment takes place approximately proportionately to the sludge concentration and, in other words, the sludge bed thickness, which simplifies the regulation control operations and also the regulation system but also a continuous, more exact height control might be arranged if required. When the pump 8 has reached a lower end position, no more signals reach M2.

The mode of operation described above, in which it has been assumed that the travelling crane moves the pump 8 forwards all the time, may be modified in such a way that the control signals from the circuit 17 are also transmitted to a regulator for the drive unit of the travelling crane to start and stop the crane in response to the operation of M2 or directly to the pump motor power. The regulator for the travelling crane may be a timer controlling the running distance (time) of the travelling crane and the length of the standstill periods of the travelling crane. As in the case first described, the pump 8 may be brought to follow a stepped curve, though modified by the stop and the start of the travelling crane, or else a path which is characterized in that the pump, when being moved into a sludge bank, automatically lifts while the travelling crane stops, whereupon the pump is lowered one step, when the flow increases, and is thereupon lowered stepwise until the pump has reached the bottom level and the flow increases again, whereby the travelling crane is started for moving the pump stepwise or continuously forwards until the flow decreases again due to increased sludge depth and sludge concentration.

Figure 4:
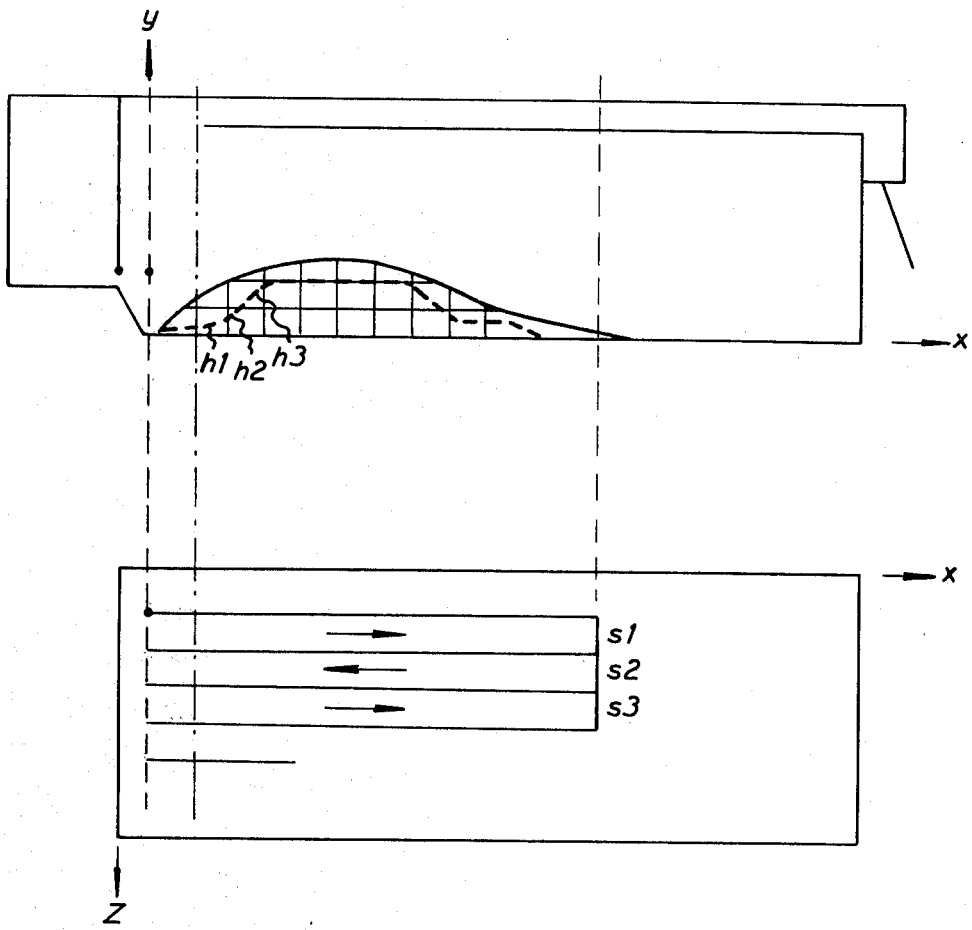
FIG. 4 is a diagram showing an imagined sludge bed profile and a program for horizontal movement of a travelling crane carriage with the pumping equipment of FIG. 2 in combination with vertical adjustment of a pumping unit in the basin in dependence on the sludge bed thickness through signals from the electric circuit of the pump motor.

In the case first described, the pump at each turn of the travelling crane, works the sludge bed laterally within its reach until the bed is worked up, and in the other case the pump works the entire sludge bed within its reach down to the bottom level during a single turn of the travelling crane 5. These two cases are schematically illustrated in a very simplified manner in FIGS. 4 and 5, where the dashed line indicates the movement of the pump in the first case and the squared pattern indicates the sludge layers worked in the second case during a movement of the travelling crane in steps *s*1, *s*2, *s*3, etc., and raising and lowering of the pump in steps *h*1, *h*2, *h*3, etc. The squared pattern gives no exact picture of the progress since it does not show the movement of the pump into the sludge bank, before the raising movement takes place, nor the movement of the pump towards the outer layer of the bank, where the lowering movement takes place. In the lower part of FIG. 4 there is shown a lateral displacement step of the travelling crane carriage 6 at the end of each turn of the crane 5 in either direction.

Figure 5:
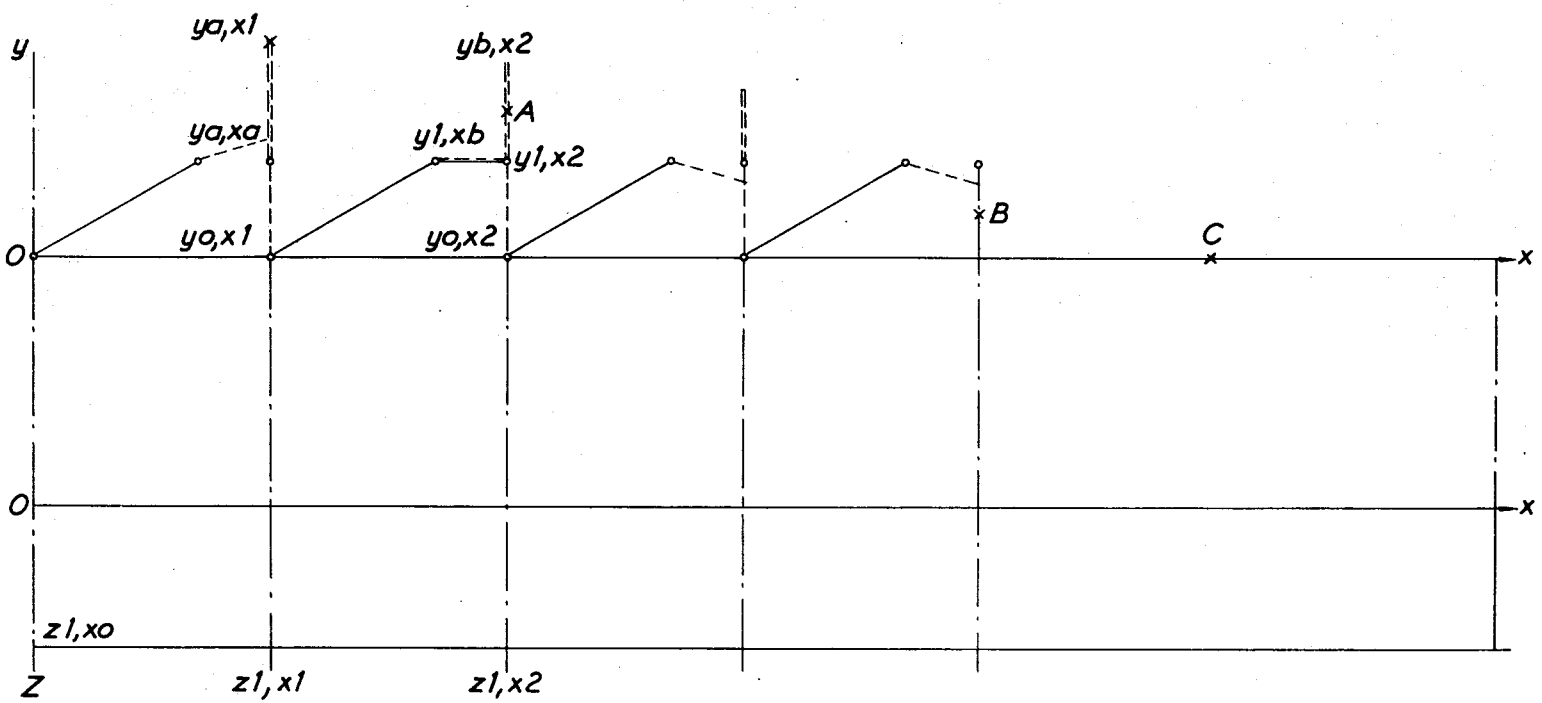
FIG. 5 is a diagram illustrating a more advanced automatic program in which time is incorporated as a fourth dimension, through a time relay device, in the automatic control of the plant of FIG. 1.

FIG. 5 shows a further development of an automatic program which may be easily set in a program unit (not shown) of per se known type in the regulation circuit 17 in which R2 (and possibly R3) is connected to the travelling crane motor via a signal circuit 16″. The program in FIG. 5 may be explained most simply by a description of the various events beginning at a point O, where the pumping unit is assumed to have reached an end position near the basin bottom of which a longitudinal section is represented by the x-axis in a system of coordinates where the y-axis represents the vertical axis of the elevation of the pump. It is also assumed that the pump 8 moves with its nozzle 20 through a sludge bank the profile of which is approximately reflected by the peaks in the diagram of FIG. 5.

When the travelling crane is started for moving the pump forwards one step from the O position to *x*1, M2 is started by means of the timer for forcing the pump to raise one step O-*y*1 (e.g. half a meter). Thus, during the first part of its movement the pump is displaced along a rise while sucking slurry from the bank approximately in parallel with the sloping front of the bank. If the height of the bank does not increase in point *y*1, the raising movement of the pump automatically stops in this point by the expiration of the timer for M2, and here it may first be assumed that the travelling crane 5 thereupon, under the control of another timer, moves the pump 8 horizontally to the point *y*1, *x*1 where the travelling crane stops. When the sludge concentration in point *y*1, *x*1 decreases, this is sensed by the power sensing means which, via R2 in circuit 17 in FIG. 2, starts M2 for lowering the pump. Meanwhile the travelling crane is kept standing still by means of its timer whereby the pump works up the slurry bed stepwise down to its bottom along a strip having the width *z*1 and the length *x*1, which is indicated in the lower part of FIG. 5 where the section in the upper part of FIG. 5 is shown in a plan view. When the pump has reached position *y*o, *x*1, the travelling crane and the pump are started by means of their timers and a new cycle commences.

However, if instead of the process described above the power sensing means 18 in point *y*1, *x*a, or between this point and *y*1, *x*1, senses an increasing sludge concentration (sludge level), then M2 starts automatically for raising the pump 8 by steps to the pont *y*a, *x*1. When the sludge concentration in point *y*a, *x*1 has been reduced to a sufficient degree due to the pumping operation, another lowering signal is issued from the power sensing means via R2 (FIG. 2) and the pump is lowered to the point *y*1, *x*1, while the travelling crane is kept standing still, and when the sludge concentration has decreased sufficiently due to the pumping operation, another lowering signal is issued and the pump is lowered to the bottom level at *y*0, *x*1, where the pump works until the concentration has become sufficiently low to allow another lowering signal to be transmitted to M2 but, since the pump in *y*0, *x*1 is in its bottom position, this signal will have no effect on M2. The timer of the travelling crane motor instead receives the signal and starts and the travelling crane is put into operation and is moved a step forwards, at the same time as also the timer for M2 is actuated and a new cycle is initiated. This cycle may be a reiteration of one of the two described alternatives or, for instance, as shown, a movement of pump *y*0, *x*1–*y*1, *x*b–*y*1, *x*2–*y*b, *x*2–*y*0, *x*2. The other cycles are readily understood from the diagram and with the guidance of the above description and therefore it should only be mentioned that the dashed lines indicate that various alternatives of movement may come into question and are determined by the contour of the sludge bank. For the other cycle in the diagram, however, there are shown certain events at A, B and C, which will be described.

In point A it is assumed that the pump has been blocked by gas, which it has sucked from a gas pocket in the slurry, or, for instance, by a piece of bark across the pump inlet 20. The flow rate then goes towards zero and the power is strongly reduced. A power breaker EB in the pump motor circuit which is regulated by means of a relay R4 in the regulation circuit stops the pump and breaks R2 and connects R3 and starts at the same time a timer in the relay. The water in the conduit 7 then flows downwards and removes the flow obstacle. If the blocking should depend on some other fact than those described above, it would probably depend on material having clogged at the inlet of the valve 15 which, in normal working position, is not fully open. At the same time as R3 is connected, a valve opening signal therefore passes to M3 which opens the valve completely. After the time set by the timer has expired, the power breaker EB closes again and M1 starts again and the regulation circuit 17 is closed to R2 for resetting the connections via 16 and 16″ to M2 and the travelling crane motor, respectively. A slight delay between the start of M1 and the switching from R3 to R2 is produced because R1 operates with a somewhat longer connecting time than R4, and thus there will be sufficient time to remove clogging at the valve 15 and the valve can be switched over to the normal position when the flow increases, before R3 is disconnected and R2 is connected.

In point B, where the sludge bank is worked up, the flow and the pump motor power strongly increase because it is substantially only water that is pumped, while R1 switches S over from R2 to R3 and, at the same time as the pump reaches the bottom position, the end position breaker in 14 breaks the circuit for M2. R3, which now senses the demand signal for flow regulation, transmits a signal to M3 for regulation of the valve 15. In position C, the AUMA means in 14′ starts a time relay in R3 and thus stops the travelling crane. The contact in the AUMA means functions as a holding contact and when this is released, after expiration of the time relay, the travelling crane starts again and the time relay is set to zero, whereupon the pump is moved without steps to the end position of the travelling crane, provided that no new sludge bank is encountered.

Figure 6:
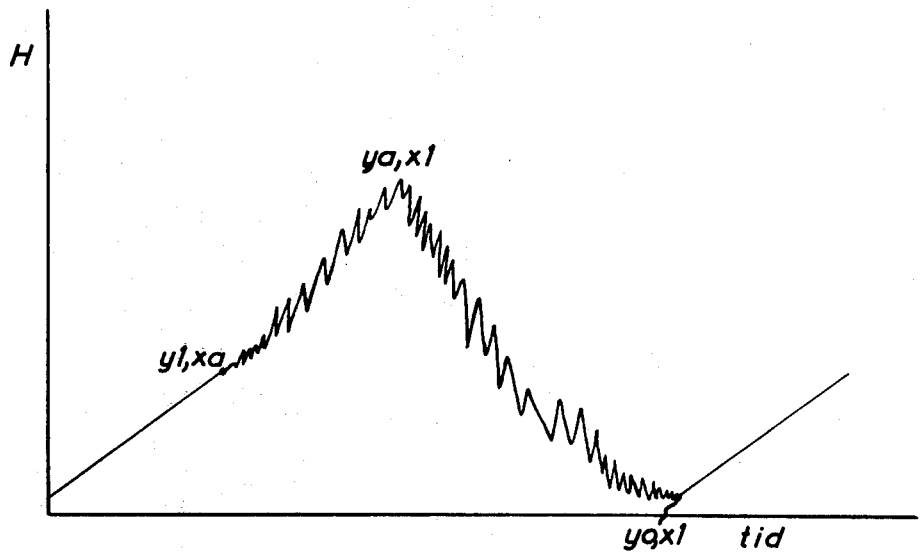
FIG. 6 illustrates the depth adjustment with respect to time.

The movement of the nozzle (pump) in the vertical sense, while the nozzle simultaneously works up the bank within its reach in the horizontal sense, is thus determined by the power variations of the pump motor around the desired value Pb in FIG. 2 but is of course also influenced by a time factor in the depth level adjustment system. This movement with respect to time may, for instance, have the pattern shown in the diagram of FIG. 6 where H is the height over the basin bottom and *t* is the time during a working cycle, for instance the first working cycle in FIG. 5. As is shown, first the pump is forced to move upwards to position *y*1, *x*a, from where the pump is displaced in small steps upwards to the point *y*a, *x*1 and thereupon in small steps downwards to the lower end position *y*0, *x*1, whereupon a new cycle is initiated. The regulation system may be arranged for small or large height changes in each step. In the preferred embodiment, however, there is aimed at a movement control where the frequency and amplitude are proportional to the power variations.

It is also possible to control the longitudinal movements of the travelling crane in the same way, i.e. in small feed steps where the frequence and amplitude are proportional to the power variations of the pump motor.

The flowmeter 21 in FIG. 3 may be used alternatively or optionally as power sensing means, which is indicated by dashed lines in FIG. 2, where the flowmeter is connected to the conduit 7 and its output signal circuit 22 to the regulation circuit 17. It should be noted that the flowmeter also indirectly indicates the sludge concentration and the pump motor power and thus it may advantageously be replaced by a power sensing means which permits a simpler and more quickly reacting regulation which, besides, may be carried out by means of a less expensive apparatus.

As a flowmeter 21 there may be used a magnetic flowmeter with a measured value transformer and measured value transmitter of the type sold by the firm TURBO-WERK KOLN, West Germany, or some other suitable flowmeter of per se known type, and, as shown in FIG. 3, the measuring signal in the conduit 22 may be sensed, as at 24, and be transmitted to an instrument 23 of per se known type which transforms the measuring signal into volume per unit of time or which indicates e.g. the number of liters per minute. The instrument 23 may be placed at a distance from the plant and may be used for remote control, and as instrument 23 there is preferably used some per se known recording, indicating and summing type instrument available in the market.

It appears from the foregoing that the invention permits an efficient, comparatively simple program control of the slurry sucking operation in a sedimentation basin and that the slurry sucking operation can be carried out without it being necessary to move the pump (or alternatively only a suction nozzle) deeply down in a sludge bank. The nozzle 20 (or the pump) operates at a level in the slurry where it moves without difficulties, but this is not the case, for instance, when the end of a long vertical tube is to be moved at the bottom where the resistance of the sludge may produce an unallowable torque on the tube or produce too heavy braking forces to the movement of the travelling crane. The invention further offers the advantage that the nozzle 20 can operate with a sludge concentration that is optimal from the point of view of efficiency and without the movements causing sludge to be suspended again in the water.

In the foregoing it has been assumed that only one pump 8 with one nozzle 20 is controlled by means of the control equipment but of course a pump with several nozzles, or several pumps, may be controlled at the same time and, if several pumps are used, the control may be carried out by sensing the power of only one of the pumps or the average power of several or all the pumps.

The method and the apparatus of this invention may also be used for delivering other sediments than sludge and in other water or liquid bodies, e.g. for delivering sand or other sedimented material from sea bottoms, within the mining industry for drawing up slime or like material on the bottom of a basin or the like, for taking up material in layers, etc.

What I claim and desire to secure by Letters Patent is:

1. A method of controlling a suction device used for sucking material suspendible in fluid, especially sedimented material, from the bottom of a liquid body, said device being movable along at least one axis including at least one suction nozzle, means for producing suction in the nozzle, and means for supporting and moving said nozzle in relation to said material for sucking material and fluid as a suspension, wherein variations under and above predetermined limits of at least one magnitude which is characteristic of the operation of the suction device and which varies in response to the rate of flow through the nozzle, are sensed and used as signals for controlling a movement of the nozzle along at least one horizontal axis.

2. The method as claimed in claim 1 wherein said variations of the sensed magnitude are used for controlling a movement of the nozzle along a vertical axis to control the operating level of the nozzle.

3. The method as claimed in claim 1, wherein movements of the suction device are controlled according to changeable programs and said variations of the sensed magnitude are used for program changing in movements along at least one axis and for depth level adjustment of the nozzle.

4. The method as claimed in claim 1, wherein an electric pump motor, the effect characteristic of which is substantially linear within the normal operating limits for the motor, is used and variations over predetermined limits of the power fed to the motor are sensed and used as a measure of said magnitude.

5. The method as claimed in claim 1, wherein said variations of the sensed magnitude are utilized as electric control demand signals which are transmitted to an electric control circuit for transforming said signals into control signals and transmitting the control signals to an electric depth adjustment motor for controlling the operating level of the nozzle.

6. The method as claimed in claim 1, wherein the movements of the suction device are controlled along three perpendicular axes.

7. The method as claimed in claim 6, wherein time is introduced via a timer as a fourth dimension into the controlled operation for delaying the effectuation of at least one movement along at least one of said axes after the output of a control demand signal.

8. A control system for controlling the movement of a suction device used for sucking material which is suspendible in fluid, from the bottom of the liquid body, including at least one suction nozzle, an electric pump motor for producing suction in the nozzle, means supporting the nozzle for moving the nozzle in the liquid body, said device comprising sensing means for sensing variations of a magnitude related to the rate of flow through the nozzle, a signal producing means connected to said sensing means to be actuated thereby for transmitting signals proportional to said variations, an electric control circuit connected to said signal producing means and to said means supporting said nozzle, said circuit being adapted, on receiving signals from said signal producing means representing variations of said magnitude above certain limit values or around a set value, to transmit such signals to the nozzle moving device to be guided by the nozzle, wherein the sensing means are connected to sense the consumption of electric energy of the pump motor and wherein said means for supporting and moving said nozzle comprise a depth level control means including an electric motor connected to said electric control circuit to be automatically controlled thereby in response to said control signals from said signal producing means.

9. A control system as claimed in claim 8, wherein said sensing means are connected to sense the consumption of electric energy of the pump motor and wherein said means for supporting and moving said nozzle comprise a drive means for moving said nozzle in the horizontal direction, said drive means being connected to said control circuit to be automatically controlled thereby for moving said nozzle in at least one horizontal direction.

* * * * *